United States Patent [19]

Krenek, Jr.

[11] Patent Number: 4,721,335

[45] Date of Patent: Jan. 26, 1988

[54] PULLER FOR FENCE POSTS OR THE LIKE

[76] Inventor: Paul Krenek, Jr., Rte. 2, Box 125A, East Bernard, Tex. 77435

[21] Appl. No.: 928,251

[22] Filed: Nov. 7, 1986

[51] Int. Cl.[4] ..... B66C 1/44

[52] U.S. Cl. ..... 294/104; 254/132

[58] Field of Search ..... 294/15, 16, 92, 101, 294/102.1, 103.1, 104, 110.1, 111, 113, 114; 254/30, 31, 130, 132, 133 R, 134

[56] References Cited

U.S. PATENT DOCUMENTS

| | | | |
|---|---|---|---|
| 1,153,024 | 9/1915 | Brown | 294/104 |
| 1,177,771 | 4/1916 | Goble | 294/104 |
| 1,271,876 | 7/1918 | Fairbanks | 294/104 |
| 1,473,724 | 11/1923 | Gibson | 294/104 |
| 1,533,429 | 4/1925 | Koehn | 294/104 |
| 1,801,448 | 4/1931 | Neeley | 294/92 |
| 2,553,077 | 5/1951 | Braun | 254/132 |
| 2,568,263 | 9/1951 | Wiseman | 294/104 |
| 3,066,915 | 12/1962 | Linabery | 254/132 |
| 3,534,996 | 10/1970 | DeWitt | 294/102.1 |
| 4,422,621 | 12/1983 | Ekern | 294/102.1 X |

FOREIGN PATENT DOCUMENTS

| | | | |
|---|---|---|---|
| 163931 | 7/1958 | Sweden | 294/104 |

*Primary Examiner*—Johnny D. Cherry

*Attorney, Agent, or Firm*—Charles W. McHugh

[57] ABSTRACT

A post-puller adapted to be utilized by a farmer or similar person who is riding on a tractor or equivalent piece of equipment, the tractor having an attachment with the capacity to produce a vertical lifting load—to pull a fence post out of the ground. The apparatus includes a cage-like frame with an opening that passes centrally through the frame, the apparatus being adapted to pass over the top end of the post to be pulled. The cage-like frame has two spaced gripping members on its interior; these gripping members are preferably made of angle iron that is oriented so that the apex of the 90 degree angle will bear against a post that is positioned inside the cage. A lever is pivotally mounted on the side of the cage opposite the gripping members, and the lever has a surface or edge that bears against one side of a fence post to wedge it against the gripping members on the other side. Lifting upward on the outer end of the lever rotates it to a post-engaging position, and releasing the outer end will allow gravity to restore it to a non-binding position—when there is no weight on the lever as a result of supporting a post. When a rope or the like is used by a farmer to selectively lift the outer end of the lever, the farmer can drive his tractor to a location adjacent a standing fence post, position the cage over the top of the fence post, pull the post of the ground, release the post, and move to another location—all without having to leave the seat of his tractor.

4 Claims, 6 Drawing Figures

PULLER FOR FENCE POSTS OR THE LIKE

BACKGROUND OF THE INVENTION

This invention relates generally to devices for lifting fence posts and similar elongated objects out of the ground; more specifically, it relates to a cage-like structure which is adapted to be dropped over the exposed end of a post, and including elements which engage the post so as to lift it when the cage is raised.

The use of fence posts to surround real property is well-known, and many different types of fence posts have been utilized from time to time. Some posts are essentially cylindrical, as a result of fabricating the posts from the trunks of small trees. Other posts have been manufactured from steel rods, and they frequently have a T or V shape in order to have a reasonably high area moment of inertia without an unreasonably great weight. Once fence posts are installed in the ground, however, they are not necessarily left there forever. They may be removed and relocated as a matter of choice, or to comport with new ownership of a certain parcel of land. If the posts are wooden, they often are subject to deterioration, and they must occasionally be pulled from the ground and replaced with new, sound posts. Examples of post pullers which are capable of pulling cylindrical posts include the devices shown in U.S. Pat. No. 3,848,850 to Bemis entitled "Vehicle Mounted Hydraulic Powered Post Puller"; U.S. Pat. No. 2,482,950 to Toftey entitled "Post Puller"; and U.S. Pat. No. 3,647,185 to Phibbs entitled "Power-Operated Pulling Implement". Additional post pullers are known which are specific to metal fence posts; examples include U.S. Pat. No. 3,762,687 to DeRome entitled "Post Pulling Apparatus"; U.S. Pat. No. 4,161,317 to Parker entitled "Metal Fence Post Puller"; and U.S. Pat. No. 4,422,621 to Ekern entitled "Fence Post Puller".

With regard to the pullers for cylindrical (or so-called round) posts, essentially all of them are characterized by being either bulky or heavy or both. Furthermore, they are usually adapted to grasp a fence post near the ground, which means that there must be a clear field of view for the worker to be able to see essentially all of the post and to have space for working around the bottom of the post. In practice, however, there are many instances where cactus and bushes or small trees have grown up around fence posts, thereby making access to the bottom of the post a very difficult matter. A farmer who can see the top of a fence post that he knows needs to be replaced will not necessarily be able to see the bottom of the post without first doing a lot of manual work in clearing away the brush, etc. It would be desirable, therefore, to have a puller for fence posts and similar elongated objects which does not require engagement near the bottom of the fence post.

When the fence posts are metal, pulling devices such as the aforementioned devices of DeRome, Parker and Ekern are capable of lifting a post after it has been initially grabbed near the top thereof. But while these three metal post pullers solve one problem, they introduce other problems. For example, the Ekern device requires that a person be physically next to the post where he can handle a pin 33 and insert it into two juxtaposed slots 27, 27 in order to engage the post. After the post has been pulled from the ground, the pin 33 must then be grabbed and shifted transversely in order to separate the puller from the post. Both the steps of engaging and disengaging the puller require that a farmer, rancher or other operator climb down off a tractor to manually manipulate the post puller, and then climb back on the tractor in order to move to a different location for pulling the next fence post. Alternatively, two people would be required to utilize an Ekern post puller, one of which drives the tractor and the other who walks from post to post, sequentially engaging and disengaging the puller. The need for manual engagement/disengagement is typical of the DeRome and Parker post pullers, also. Hence, there has still remained a need for a post puller which has the simplicity and economy of pullers equivalent to those represented by DeRome and Ekern, but which are capable of being remotely engaged and disengaged by a tractor operator who never leaves the seat of his tractor.

A further object is to provide a post puller which is capable of lifting both round posts (such as cedar or oak fence posts) and metal posts (such as those illustrated in the DeRome and Ekern patents).

Still another object is to provide a post puller which is capable of engaging an elongated object like a post or pipe which is oriented in some direction other than vertical. Indeed, it would be advantageous to provide a puller which could be engaged with a metal post that has been bent over such that it is almost parallel to the ground—as if an errant vehicle had inadvertantly run over the post, etc.

One more object is to provide a post puller which is capable of being utilized by a single operator and which permits that operator to ride safely on a tractor where he is above snakes, ants, scorpions, cactus, thistles and other potentially hazardous things.

BRIEF DESCRIPTION OF THE INVENTION

In brief, the above-recited objects (and others) are satisfied by providing a sturdy but relatively small cage-like device which is adapted to pass over the top end of a post or other elongated object that is to be lifted. Pivotally associated with the cage is a lever having a relatively short arm which extends interiorly of the cage, and a relatively long arm which extends exteriorly from the cage. The interior arm has a post-engaging yoke which is adapted to bear against one side of a post and wedge it against an opposing side of the cage. Lifting upward on the distal end of the long arm causes the arm to pivot from near vertical to near horizontal, and contributes to wedging of the post within the cage so that lifting the cage will simultaneously lift the post. A rope tied to the distal end of the lever permits the operator to cause the desired engagement of the yoke with the post while the operator remains seated at his elevated position on a tractor that is equipped with a hydraulic lifting attachment or the like.

After a post has been pulled from the ground, the cage need only be lowered enough so that the bottom end of the post comes in contact with the ground; when the weight of the post is partially released, the lever will automatically fall away from its engaged position—by virtue of the relatively large weight of the long arm in comparison with the relatively small weight of the short arm and its associated yoke. When the yoke is no longer bearing tightly against the post, the cage is free to be simply lifted away from the post, so that the tractor operator is ready to move to a new site for pulling another post.

DETAILED DESCRIPTION OF A PREFERRED EMBODIMENT OF THE INVENTION

Figures 1, 6:
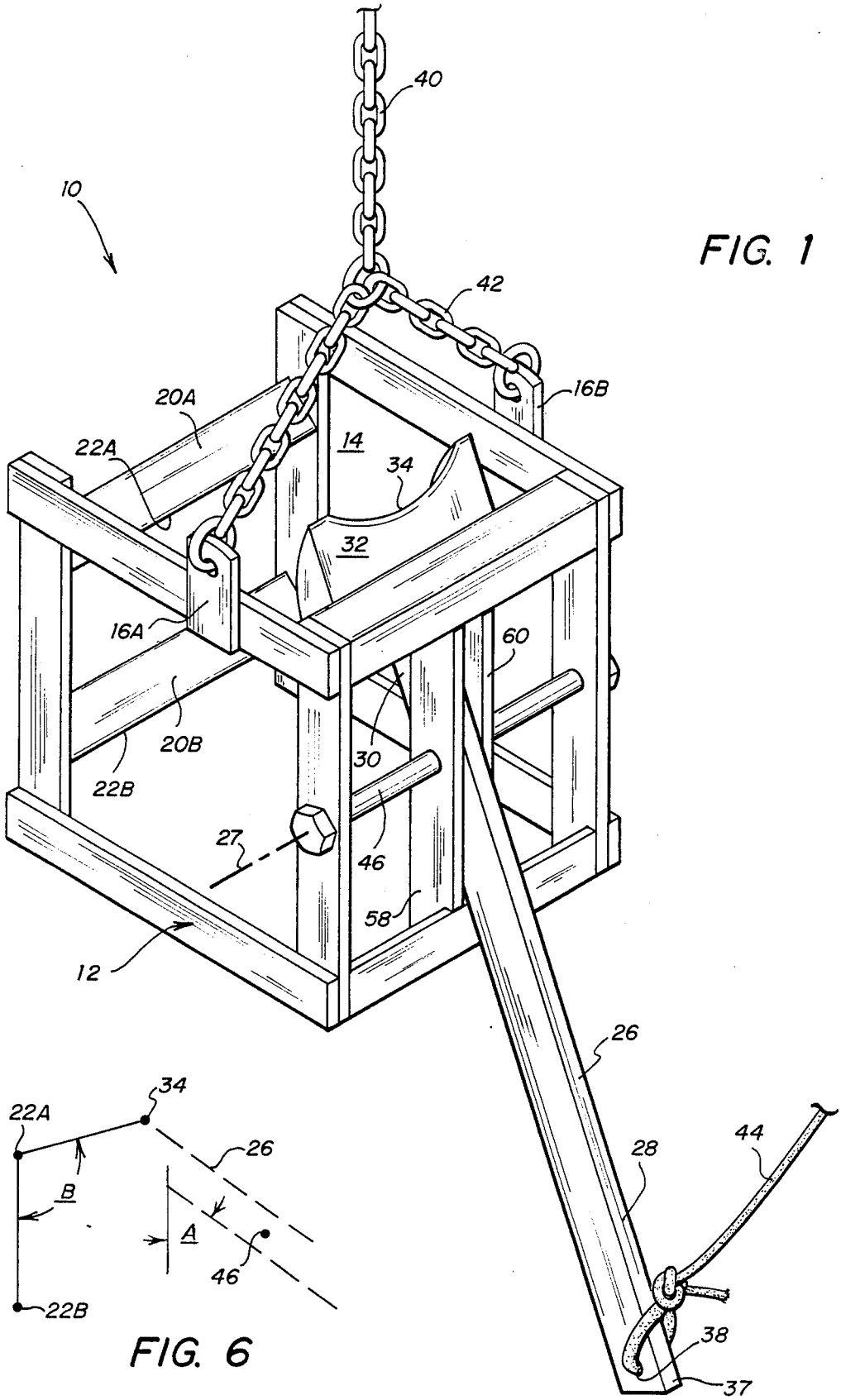
FIG. 1 is a perspective view of one embodiment of the invention.
FIG. 6 is a diagrammatic showing of the spatial relationships of certain important parts of the post puller.

Referring initially to FIG. 1, an apparatus 10 which is particularly advantageous for pulling fence posts and other elongated objects out of the ground includes a rigid structural member 12 which may be casually referred to as a "cage". The cage 12 actually constitutes a rigid frame formed by permanently securing structural members together in such a way that there is provided a vertically oriented opening when the cage 12 is suspended (from its top) with a vertical orientation. The structural pieces which define the cage 12 are sized so that the opening 14 will be slightly larger than the cross-section of the largest object which is to be pulled from the ground. Thus, the cage is sized so that a post or other elongated object may be inserted into the opening 14 by virtue of lowering the cage or frame 12 over the exposed object. Because most fence posts have a diametral dimension of less than 8 inches, a preferred length for the horizontal members of the cage 12 is slightly longer than the anticipated post size, e.g., about 10 inches.

Located at the top of the cage or frame 12 is a means for transferring lifting loads to the frame. Such a means can be as simple as a pair of spaced lugs 16A, 16B which are welded to two of the upper frame members. These lugs 16A, 16B are adapted to receive hooks, bolts or other fasteners which secure a chain or cable to the frame. The length of chain or cable will obviously be a matter of choice to the person who is utilizing the apparatus 10, and will depend to a great extent upon the type of unit which is to be used to provide a lifting load. For example, a farmer may have a tractor with a hydraulic cylinder mounted as a piece of auxiliary equipment—and through which a lifting load can be easily realized. Also, a forester could have a truck or similar vehicle upon which is mounted a winch that could also provide a lifting load—if suitably combined with a gin pole or equivalent apparatus. Hence, it should be understood that any of a variety of mechanisms might be utilized to provide the lifting load through which this invention operates.

The frame 12 may also be described as having a front and a back, as well as a top and a bottom. Internally of the frame, i.e., facing the opening 14, a pair of spaced gripping members 20A, 20B are positioned at the back of the frame so that they face inwardly. These two gripping members 20A, 20B are technically passive; that is, they do not have active or movable surfaces like the work-contacting surfaces of a pair of pliers. Instead, they have a configuration which promotes frictional engagement with a fence post when the post is forced against the members. One way that engagement with a fence post is fostered is to construct the gripping members 20A, 20B from two pieces of steel angle iron, with the apex of each piece facing inwardly toward the opening 14, and the respective sides of the pieces sloping outwardly at 45 degree angles with respect to the vertical. In this manner, a V-shaped edge is provided on each gripping member, and both edges 22A, 22B extend horizontally across the back of the frame 12. The vertical spacing of the gripping members 20A, 20B may be at least partially determined by the size of the frame 12, which of course is determined in part by the size of the posts that are to be pulled by the apparatus 10. But, it is believed that a spacing of about 5 inches between the upper and lower gripping members 20A, 20B is desirable in order to foster the kind of gripping that is a prelude to easy lifting.

A handle 26 is pivotally mounted about a horizontal axis 27 on the front of the frame 12, with the axis being positioned so that it passes through a plane that is established by the front of the frame. For simplicity, the actual thickness of the frame is being considered as being of minimal size, so that the "front" can be referred to as lying in a single plane instead of a plurality of closely spaced and parallel planes. That is, the front part of the rigid frame 12 obviously has a thickness, but that thickness is not important for an understanding of the principle of the invention—so the thickness is being ignored at this point in order to simplify the description.

A handle 26 has two portions: a relatively long portion 28 which lies outside the frame 12, and a relatively short portion 30 which extends interiorly of the frame. Provided at the distal end of the short portion 30 is a post-contacting element 32; this element has an edge 34 which is configured to bear against and engage or "grip" the outer surface of a post that has been inserted into the frame 12. In view of the fact that nearly all wooden posts are generally cylindircal, an optimum configuration for this distal edge 34 is at least partially concave; an alternative configuration is more nearly like a shallow V.

Figure 2:
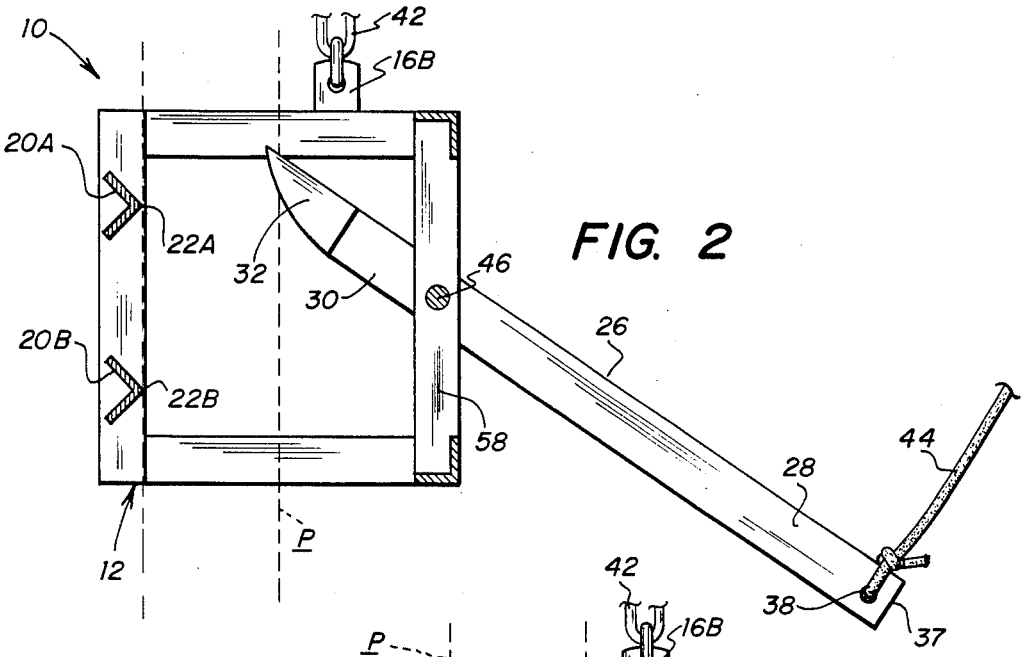
FIG. 2 is a cross-sectional view of one side of the apparatus, with the handle being shown in an elevated position.

Referring additionally to FIG. 2 (a side view of the apparatus 10), it will be seen that the axis 27 is positioned so that the distal end of short leg 30 will rest between the upper and lower horizontal edges 22A, 22B when the handle 26 is moved to a position such that it extends approximately perpendicular to the frontal face of the frame. This is the position at which the interaction between gripping members 20A, 20B and element 32 is approximately at its maximum.

Figure 3:
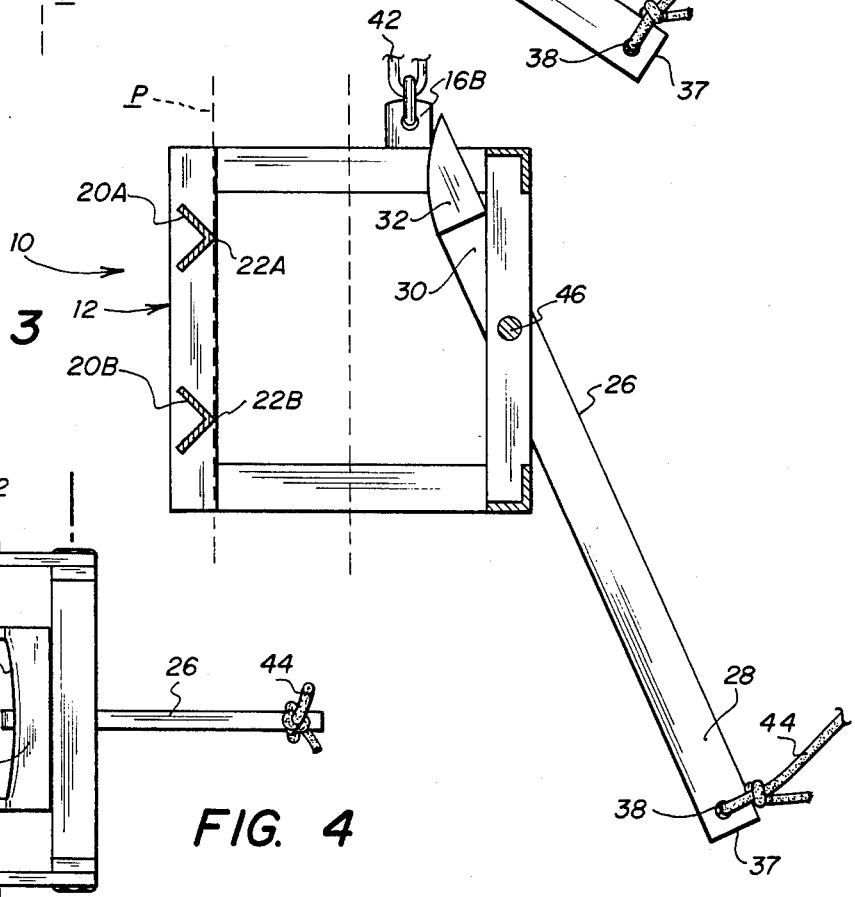
FIG. 3 is a cross-sectional side view, similar to FIG. 2, with the handle being shown in its lowest (rest) position.

While the gripping surfaces may be present on the apparatus 10 at all times, there still remains a requirement for bringing these gripping surfaces into active play on a post that has been positioned interiorly of the frame. The preferred manner of achieving engagement with a post is what will be categorized herein as the "automatic release" configuration, which is established by the judicious proportioning of the weights of both the long and short portions of the handle 26. By making the weight of the long portion 28 significantly greater than the weight of the short portion 30, the handle will normally be biased into a position where the long portion is lower than the short portion. This rotational biasing of the handle 26 to a non-engagement position is illustrated in FIG. 3. That is, the apparatus 10 as shown in FIG. 3 does not have its parts oriented to accomplish the gripping and lifting that is desired, whereas the relative position of the parts in FIG. 2 provides an excellent lifting capability. To move the handle 26 from its rotated-down orientation, there needs to be some way of pulling upward on the distal end of long portion 28. One way this is accomplished is by providing an aperture 38 near the distal end 37, so that a small rope 44 or the like may be easily connected to the distal end 37.

Figure 4:
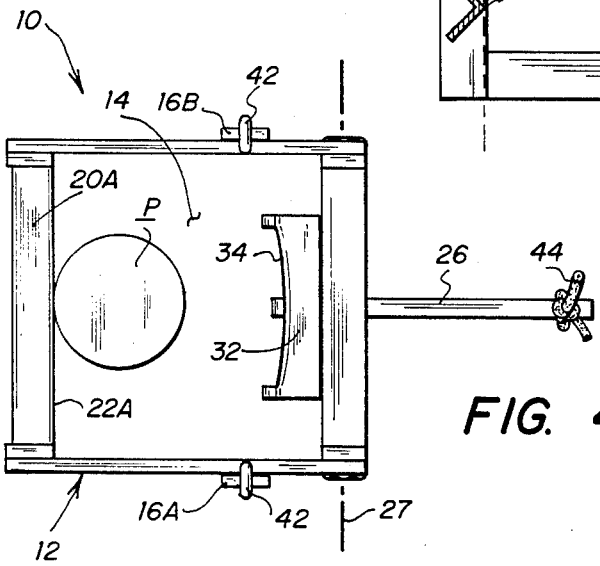
FIG. 4 is a top plan view of the apparatus shown in FIG. 3.

In use, it will be assumed that a farmer has a tractor with a hydraulic cylinder attachment which is capable of providing lifting loads in a generally vertical direction. And, it will be further assumed that the farmer has attached a chain 40 to the lifting apparatus so that lifting loads may be realized by pulling upward on the chain. By connecting the chain 40 to apparatus 10 through a short auxiliary chain 42, the apparatus 10 may be selectively positioned with respect to a fence post by properly maneuvering the tractor. By placing the apparatus 10 so that it is over the fence post P, the farmer need only lower the chain 40 so that the cage 12 will descend around the post (which passes into opening 14, as shown in FIG. 4). The cage 12 at this time will have its various parts in the relative position indicated by FIG. 3. After passing a short distance over the exposed end of the post, the farmer will then give an upward pull on the distal end 37 (by pulling on rope 44) so as to elevate leg portion 28 with respect to the frame, thereby causing edge 34 to rotate downward until it comes into contact with the adjacent surface of the fence post. Next, chain 40 is lifted at the same time that light tension is maintained on rope 44, which causes the fence post to become wedged between the gripping members 20A, 20B and the contact element 32. The lifting load imposed on the post by the apparatus 10 may be substantial, approaching even several hundred pounds, while the tension in rope 44 may be only a relatively few pounds. That is, the substantial lifting force generated by the tractor's hydraulic unit is not in any way passed through rope 44—which is lightly controlled by the farmer's manual touch.

After the post has been pulled from the ground, the weight of the post will normally be enough to maintain the gripping action of the spaced elements 20A, 20B, 32, so that the continued application of tension in rope 44 is no longer necessary. The farmer may therefore relax his grip on rope 44, and drive the tractor to a collection spot for salvaged posts, or the post may be discarded immediately next to where it was pulled from the ground. Disengagement of the post from the apparatus 10 is very simply accomplished by lowering chain 40 until the bottom end of the post comes into contact with the ground. As soon as at least some of the weight of the post is supported by the ground, the heavier weight of handle portion 28 will cause it to fall and short portion 30 will rise, thereby causing contact edge 34 to rotate upwardly and away from the post. Very quickly, then, the upper end of the post will be free of any gripping action by the apparatus 10, and the apparatus may simply be lifted away from the now-free post by pulling upward on chain 40.

It is believed to be worthy of mention that all of the above-described procedure for pulling a post from the ground can be accomplished without requiring the farmer to leave his seat on the tractor; nor is there any necessity for a helper to be on the ground next to a fence post in order to either engage or disengage the puller 10. The risk of being bitten by ants, spiders, scorpions or snakes (which frequently inhabit the high grass along a fence row) is thereby eliminated, as is the risk of being stuck by thistles, briars, cactus and other thorny plants along a fence row.

Another embodiment of the invention disclosed herein (FIG. 5) includes a handle 26A having a plurality of apertures 50, 52, 54, each of which is large enough to accommodate a bolt 46 which serves as the fulcrum for handle 26A. By temporarily removing bolt 46 and repositioning the handle 26A with respect to the frame 12, the relative spacing between distal edge 34 and edges 22A, 22B can be selectively adjusted. For large posts, aperture 50 would be chosen to be engaged with bolt 46; for much smaller posts, aperture 54 would naturally be selected as the operative fulcrum point. But regardless of which aperture is selected, the operation of the apparatus 10 is essentially the same.

One further comment about the strength of the frame 10 is perhaps in order. Those persons who are familiar with principles of mechanics will appreciate that loads being transmitted from the post through the element 32 and handle portion 30—to the frame 12—will be placing a significant bending load on the middle of bolt 46. And, while it would be feasible to substantially increase the diameter of bolt 46 as well as the size of the vertical legs of frame 12 which support that bolt, it is believed preferable to use more moderately sized elements for the entire structure—but reinforce these elements where support is most needed. To that end, auxiliary vertical members 58, 60 are preferably provided near the midpoint of the front face of the frame 12, so as to provide additional resistance to the bending of bolt 46 by the substantial lifting loads that are typically applied to a fence post. These vertical members 58, 60 are rigidly attached to the frame 12 (as by welding) with a space between them that is just large enough to accommodate the thickness of handle 26 or 26A. The apparatus 10 can, of course, be disassembled and shipped more compactly when a handle 26 is not positioned at its operative location at the front of the apparatus; and, inserting the handle between vertical members 58, 60 and then inserting bolt 46 makes assembly of the entire apparatus very easy.

Figure 5:
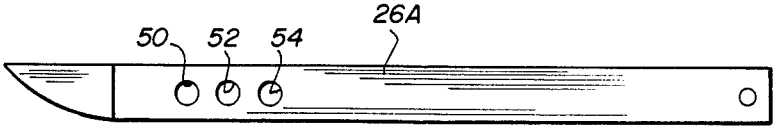
FIG. 5 is a side view of an alternate embodiment of a handle—which is capable of being attached to the frame of a post puller using any of three attachment holes.

Referring again to FIG. 2, while still referring to FIG. 5, it will be appreciated that the choice of apertures 50, 52 or 54 with which to establish a fulcrum for the arm 26A will affect a relationship that will perhaps best be understood by reference to FIG. 6. FIG. 6 shows diagramatically the gripping relationship between edges 22A, 22B on the back side of a fence post or the like, and edge 34 on the front side of the post. As long as the angle A established by arm 26A with respect to the vertical is between 45 degrees and 89 degrees, the included angle B will be relatively large—well in excess of 70 degrees; and the lifting force on a fence post will be limited only by the capacity of a tractor or other external apparatus to provide a lifting load. However, if angle A is ever allowed to reach 90 degrees (by virtue of rotating arm 26A counter-clockwise), then any continued lifting through chain 42 will cause the handle 26A to pass "over center", and the apparatus 10 would then be pulled vertically over the stump without lifting the same. Hence, one of the apertures 50, 52, 54 will be selected as required in order that the fence puller 10 will accommodate at least most, if not all, of the posts that are to be pulled. Fortunately, the bolt 46 carries substantial loads in shear but essentially negligible loads in tension. Therefore, a nut which secures bolt 46 to the apparatus need only be lightly threaded onto the bolt, such that removing the nut and changing the fulcrum point for the handle 26A can be easily accomplished, usually without the need for any tools. If desired, a cotterpin or the like may be used to ensure that a loosely threaded nut does not become disengaged from bolt 46.

While a casual inspection of FIG. 2 might lead a person to initially imagine that the angle B of FIG. 6 should never be more than 90 degrees, experience has shown that the three-point contact that is realized with this construction leads to a much broader range of permissible values for angle B. That is, depending upon the texture (i.e., surface finish) of the post to be pulled and/or any irregularities which might be engaged by edge 34, the angle B could have a value at least as large as 120 degrees. On the other hand, providing a single contact point on either side of a post would almost surely dictate that the two points be at approximately the same elevation; this would be equivalent to restricting angle B to about 90 degrees. Also, locating the point at which lifting loads are applied through chain 42 well off center tends to make the apparatus 10 want to rotate counterclockwise, such that edge 22B tends to be forced very firmly against the post P, increasing the vertical lifting capability of the apparatus—before slippage might become a threat. It should be appreciated therefore, that the three-point engagement described herein offers significant operational advantages.

While only the preferred forms of the invention have been described herein in substantial detail, it should be obvious to those skilled in the art that various modifications thereof could be accomplished without departing from the spirit of the invention. For example, the spacing between members 20A and 20B could be increased, the shape of the cage 12 could be modified, the configuration of contacting edge 34 could be altered to more nearly foster engagement with metal posts, and the size (and shape) of the various members which form cage 12 could be altered—all without departing from the basic principle of the invention. Hence, the invention should be understood to be limited only by the terms of the claims which are appended hereto.

What is claimed is:

1. An apparatus for use in pulling elongated objects such as fence posts out of the ground, comprising:

(a) a rigid structural member constituting a frame having a vertically oriented opening therethrough, and the opening having a size that is slightly larger than the cross-section of the largest post that is to be pulled from the ground, such that the post may be inserted into the opening by the act of lowering the frame over the post, and the frame constituting an open framework of permanently connected members forming a cage-like structure into which a post that is to be lifted out of the ground is inserted;

(b) means located at the top of said frame for transferring lifting loads to the frame;

(c) a pair of spaced gripping members positioned within the opening and at the back of the frame, and said gripping members being oriented so as to face inwardly and be generally horizontal when the frame is suspended vertically, and one of said gripping members being above the other so as to define upper and lower gripping members, and said gripping members constituting pieces of angle iron which are oriented so that the apex of the angle iron is pointed inwardly of the frame, such that a sharp edge is presented by each of the two gripping members to any post that is inserted interiorly of the frame;

(d) a handle pivotally mounted on the front of the frame in such a way that it passes through the vertical plane established by the front of the frame, and said handle having a relatively long portion lying outside the frame and a relatively short portion extending interiorly of the frame, and the handle being mounted such that the distal end of the short portion is adapted to be moved between horizontal planes through the upper and lower gripping members on the back of the frame, and the handle having means at its distal end for fostering connection with a rope, whereby the handle may be manipulated with a rope from a remote location and whereby a fence post may be engaged without the necessity of having a person standing immediately next to the post; and (e) a post-contacting element mounted on the distal end of the short portion of the handle, and said element being configured to bear against a post that is inserted vertically through the frame, whereby the frame may be selectively lifted and any post which is wedged between the post-contacting element and the gripping members will be similarly lifted.

2. The apparatus as claimed in claim 1 wherein the handle has a plurality of apertures through which a bolt may be inserted in order to provide the requisite pivotal motion for said handle, and said plurality of apertures are arranged longitudinally of the the handle so that each aperture is a different distance from the post-contacting element, and wherein the weight of the long portion of the handle is significantly greater than the weight of the short portion, regardless of which of the apertures is used to provide a pivot point for the handle, whereby the handle will normally be biased by gravity into an orientation where the long portion is lower than the short portion, and whereby the sizes of posts which can be accommodated by the frame may be adjusted through the step of inserting the bolt into a selected one of the plurality of apertures.

3. The apparatus as claimed in claim 1 wherein the means for transferring lifting loads to the frame is located off the centerline of the frame in a direction away from the spaced gripping members and toward the handle, whereby a lifting load applied to the frame will be applied near the center of gravity of the apparatus, and the extra weight of the handle will not cause the frame to tilt as the frame is being routinely supported.

4. The apparatus as claimed in claim 1 wherein the handle is pivotally mounted on the frame utilizing a removable bolt that passes through the frame from one side to the other, and wherein the frame is locally reinforced so that the bolt is structurally supported near the point where the bolt and the handle are juxtaposed, whereby bending of the bolt is resisted as loads are imposed on the bolt through the handle.

* * * * *